US005122501A

United States Patent [19]

Bauer et al.

[11] Patent Number: 5,122,501

[45] Date of Patent: Jun. 16, 1992

[54] INORGANIC-ORGANIC COMPOSITE SUBBING LAYERS FOR THERMAL DYE TRANSFER DONOR

[75] Inventors: Charles L. Bauer, Rochester; Bradley K. Coltrain, Fairport, both of N.Y.

[73] Assignee: Eastman Kodak Company, Rochester, N.Y.

[21] Appl. No.: 705,432

[22] Filed: May 24, 1991

[51] Int. Cl.[5] ..... B41M 5/035; B41M 5/26

[52] U.S. Cl. ..... 503/227; 428/195; 428/447; 428/480; 428/702; 428/913; 428/914

[58] Field of Search ..... 8/471; 428/195, 447, 428/480, 702, 913, 914; 503/227

[56] References Cited

U.S. PATENT DOCUMENTS 4,700,208 10/1987 Vaniev et al. ..... 503/227
4,737,486 4/1988 Henzel ..... 503/227
4,775,658 10/1988 Matsuda et al. ..... 503/227

FOREIGN PATENT DOCUMENTS 62-218186 9/1987 Japan ..... 503/227
63-256460 10/1988 Japan ..... 346/76 PH

OTHER PUBLICATIONS

G. Philipp & H. Schmidt "New Materials for Contact Lenses Prepared from Si-and Ti-Alkoxides by the Sol-Gel Process" (1984) pp. 283-292.

*Primary Examiner*—Bruce H. Hess
*Attorney, Agent, or Firm*—Clyde E. Bailey

[57] ABSTRACT

Dye-donor elements and assemblages for thermal dye transfer processing comprising a polymeric support having thereon, in order, a subbing layer and a dye layer comprising a dye dispersed in a binder, and wherein the subbing layer comprises a mixture of:

(1) a polymer having an inorganic backbone which is an oxide of a Group IVa or IVb element, and
(2) a copolymer comprising recurring units of:
  a) an acryloxyalkoxysilane or acrylamidoalkoxysilane, and
  b) an alkyl acrylate ester.

In a preferred embodiment, the polymer is an organic titanate or a titanium alkoxide.

20 Claims, No Drawings

INORGANIC-ORGANIC COMPOSITE SUBBING LAYERS FOR THERMAL DYE TRANSFER DONOR

TECHNICAL FIELD

This invention relates to dye-donor elements used in thermal dye transfer, and more particularly to the use of a certain subbing layer between a polymeric support and a dye layer comprising a dye dispersed in a binder.

In recent years, thermal transfer systems have been developed to obtain prints from a color video camera. According to one way of obtaining such prints, an electronic picture is first subjected to color separation by color filters. The respective color-separated images are then converted into electrical signals. These signals are then operated on to produce cyan, magenta and yellow electrical signals. Then the signals are transmitted to a thermal printer. To obtain the print, a cyan, magenta and yellow dye-donor element is placed face-to-face with a dye receiving element. The two are then inserted between a thermal printing head and a platen roll. A line-type thermal printing head is used to apply heat from the back of the dye-donor sheet. The thermal printing head has many heating elements and is heated up sequentially in response to the cyan, magenta and yellow signals. The process is then repeated for the other two colors. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of dye-donor elements for thermal dye-transfer printing because of a tendency for layer delamination. While various subbing layers have been developed for photographic applications, they are not all suitable for thermal dye transfer, since dye layers for thermal systems are not gelatin based as most photographic emulsions are.

It is therefore an object of this invention to provide a subbing layer for a dye-donor element that greatly reduces the tendency for dye layer delamination.

Another object of the invention is to provide a dye-donor element having a subbing layer that improves dye layer stability.

BACKGROUND ART

U.S. Pat. No. 4,775,658 is directed to a silane copolymer combined with a colloidal silica and a releasing agent to form a network structure in the thermal dye receiving sheet. There is no disclosure in this patent, however, that such a combination would be useful as a subbing layer in a dye-donor element. Moreover, there is no disclosure in that patent that teaches or suggests the use of a metal alkoxide with a copolymer in the subbing layer.

U.S. Pat. No. 4,737,486 is directed to a dye donor element for thermal dye transfer. The dye donor comprises a polymeric support having a subbing layer and a dye layer comprising a dye dispersed in a binder. The subbing layer comprises a polymer having an inorganic backbone which is an oxide of Group IVa or IVb element. There is no disclosure in this patent, however, that teaches or suggests the use of a combination of a metal alkoxide with a copolymer having an alkoxysilane component in the subbing layer.

SUMMARY OF THE INVENTION

According to the present invention, a dye donor element for thermal dye transfer comprises a polymeric support having thereon, in order, a subbing layer and a dye layer comprising a dye dispersed in a binder, and wherein the subbing layer comprises a mixture of:

(1) a polymer having an inorganic backbone which is an oxide of a Group IVa or IVb element, and (2) a copolymer comprising recurring units of:

a) an acryloxyalkoxysilane or acrylamidoalkoxysilane, and b) an alkyl acrylate ester.

BEST MODE OF CARRYING OUT THE INVENTION

In a preferred embodiment of the invention, the polymer having an inorganic backbone is an oxide of Group IVa or IVb element, such as titanium, zirconium or silicon.

The polymer having the inorganic backbone may also be formed from an organic titanate, such as tetrakis(2-ethylhexyl)titanate, bis(ethyl-3-oxobutanolato-$O^1$, $O^3$)-bis(2-propanolato)-titanium, or isopropyl triisostearoyl titanate. Moreover, the polymer may be formed from a Group IVa or IVb alkoxide including:

A. $Ti(OC_4H_9\text{-}n)_4$Titanium tetra-n-butoxide: available commercially as Tyzor TBT ® (duPont Corp.);

B. $Ti(OC_3H_7\text{-}i)_4$Titanium tetraisopropoxide: available commercially as Tyzor TPT ® (duPont Corp.);

C. $Ti(OC_3H_7\text{-}i)_2$ $(C_5H_7O_2)_2$Titanium diisopropoxide bis(2,4-pentanedionate): available commercially as Tyzor GBA ® (duPont Corp);

D. Titanium tetra-n-butoxide mixed with tetraethoxysilane in a 1:1 ratio. Both materials are available commercially; and E. $Zr(OC_4H_9\text{-}n)_4$ Zirconium tetra-n-butoxide: available commercially as a butanol complex from Alpha products.

This polymer is used at about 2 to about 50 mole percent of the mixture with the copolymer, preferably 4 to 15 mole percent.

The acryloxyalkoxysilane or acrylamidoalkoxysilane component of the copolymer preferably has the formula:

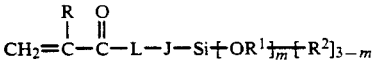

$$CH_2{=}\overset{R}{\overset{|}{C}}{-}\overset{O}{\overset{\|}{C}}{-}L{-}J{-}Si\left[OR^1\right]_m\left[R^2\right]_{3-m}$$

wherein:

R is hydrogen or a substituted or unsubstituted alkyl group having from 1 to about 6 carbon atoms such as methyl, ethyl, 2-chloroethyl, isopropyl, n-hexyl, benzyl, or phenethyl;

$R^1$ and $R^2$ are each independently a substituted or unsubstituted alkyl group having from 1 to about 6 carbon atoms, such as methyl, ethyl, n-propyl, 2-methonyethyl, 2-chloroethyl, n-butyl, t-butyl, or n-hexyl; a substituted or unsubstituted cycloalkyl group having from 5 to about 7 carbon atoms such as cyclopentyl, cyclohexyl, or p-chlorocyclohexyl; or a substituted or unsubstituted aryl group having from about 6 to about 10 carbon atoms; phenyl p-methylphenyl, p-ethylphenyl, 2,4-dimethoxyphenyl, p-propylphenyl, or naphthyl;

L is —O— or —NH—;

J is a bivalent linking group, such as methylene, ethylene, propylene, or oxydiethylene; and m is 1, 2 or 3.

In a preferred embodiment, R is methyl, L is O, J is $(CH_2)_3$, $R^1$ is methyl and m is 3.

The silane constituent is present in the copolymer up to about 20 mole percent, preferably below 10 mole percent. A particular preferred silane is methacryloxypropyltrimethoxysilane:

$CH_2{=}C(CH_3){-}CO_2{-}(CH_2)_3{-}Si(OCH_3)_3$ available commercially as M8-550® from Petrarch Systems, Inc. Other silanes useful in the invention include:

$CH_2{=}CH{-}CO_2(-CH_2-)_3{-}Si(OC_2H_5)_3$ $CH_2{=}CH{-}CO_2(-CH_2-)_4{-}Si(CH_3)(OCH_3)_2$ $CH_2{=}C(CH_3){-}CONH(-CH_2-)_3{-}Si(C_6H_5)(OC_2H_5)_2$ $CH_2{=}C(CH_3){-}CO_2(-CH_2-)_3{-}Si(OC_3H_7{-}n)_3$

The alkyl acrylate ester component of the copolymer has the formula:

$CH_2{=}CR{-}CO_2{-}G$ wherein:

R is hydrogen or a substituted or unsubstituted alkyl group having from 1 to about 6 carbon atoms, such as methyl,ethyl, 2-chlocoethyl, isopropyl, n-hexyl, or benzyl; and G is a substituted or unsubstituted alkyl group having from 1 to about 20 carbon atoms, such as methyl, ethyl, 2-chloroethyl, isopropyl, n-hexyl, 5-phenylpentyl, dodecyl, or eicosyl; a substituted or unsubstituted cycloalkyl group having from about 5 to about 10 carbon atoms, such as cyclopentylm cyclohexyl, pinethoxycyclohexyl, or p-phenylcyclohexyl; or a substituted or unsubstituted aryl group having from about 6 to about 10 carbon atoms.

In a preferred embodiment, R is methyl, and G is methyl, propyl or butyl.

Examples of alkyl acrylate esters useful in the invention include:

$CH_2{=}C(CH_3){-}CO_2C_4H_9{-}n$
$CH_2{=}C(CH_3){-}CO_2C_4H_9{-}i$
$CH_2{=}C(CH_3){-}CO_2CH_3$
$CH_2{=}CH{-}CO_2C_4H_9{-}n$
$CH_2{=}C(CH_3){-}CO_2C_3H_7{-}n$
$CH_2{=}C(CH_3){-}CO_2(CH_2)_4Cl$
$CH_2{=}C(CH_3){-}CO_2CH_2CH_2OCH_2CH_3$

In selected instances some N-alkylacrylamides, such as N-isobutylacrylamide, may also be used.

Specific examples of copolymers included within the scope of the invention are:

E-1:

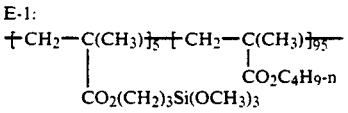

E-2:

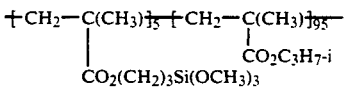

E-3:

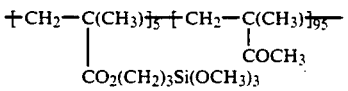

E-4:

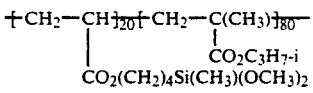

E-5:

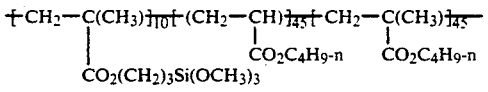

E-6:

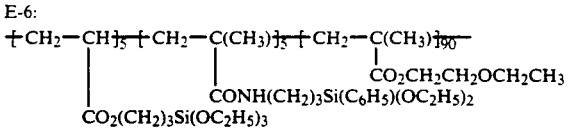

The subbing layer of the invention is prepared by facile reaction of the components (polymer with the inorganic backbone and copolymer) during the coating operation at temperatures of 48° to 65° C. for 50 to 100 seconds.

The subbing layer of the invention may be employed at any concentration which is effective for the intended purpose. In general, good results have been obtained at about 0.01 to 0.3 g/m$^2$ total coverage of composite, preferably 0.02 to 0.1 g/m$^2$.

Any polymeric binder may be employed in the dye donor element of the invention. In a preferred embodiment, the binder contains hydroxyl, amino, thio, amido, and/or carboxyl groups. For example there may be employed cellulosic binders, such as cellulose acetate, cellulose triacetate (fully acetylated) or a cellulose mixed ester such as cellulose acetate butyrate, cellulose acetate hydrogen phthalate, cellulose acetate format, cellulose acetate propionate, cellulose acetate pentanoate, cellulose acetate hexanoate, cellulose acetate heptanoate, or cellulose acetate benzoate.

The polymeric binder in the dye-donor element of the invention may be employed at any concentration which is effective for the intended purpose. In general, good results have been obtained at about 0.05 to about 5 $g/m^2$ of coated element.

Any polymeric material can be used as the support for the dye-donor element of the invention provided it is dimensionally stable and can withstand the heat of the thermal printing head. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness from about 5 to about 30 $\mu m$.

Any dye can be used in the dye layer of the dye-donor element of the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

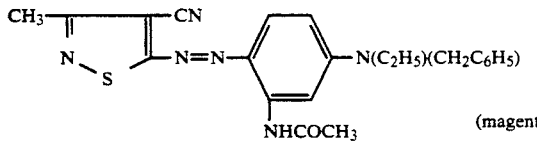

(magenta)

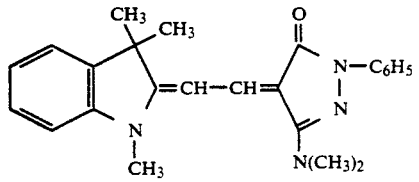

(yellow)

-continued

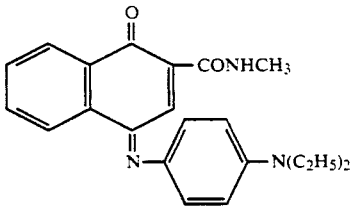

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 $g/m^2$ and are preferably hydrophobic.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface active agent. Preferred lubricating materials include oils or semi-crystalline organic solids that melt below 100° C. such as poly(vinyl stearate), beeswax, perfluorinated alkyl ester polyethers, poly(capro-lactone), silicone oil, poly(tetrafluoroethylene), carbowax®, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 $g/m^2$. If a polymeric binder is employed, the lubricating material is present in the range of 0.1 to 50 weight-percent, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as duPont Tyvek®. Pigmented supports such as white polyester (transparent polyester with white pigment incorporated therein) may also be used.

The dye image-receiving layer may comprise, for example, a polycarbonate, a polyurethane, a polyester, polyvinyl chloride, poly(styrene-co-acrylonitrile), poly(caprolactone), a poly(vinyl acetal) such as poly(vinyl alcohol-co-butyral), poly(vinyl alcohol-co-benzal), poly(vinyl alcohol-co-acetal) or mixtures thereof. The dye image-receiving layer may be present in any amount which is effective for the intended purpose. In general, good results have been obtained at a concentration of from about 1 to about 5 $g/m^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the yellow dyes thereon as described above or may have alternating areas of other different dyes or combinations, such as sublimable cyan and/or magenta and/or black or other dyes. Such dyes are disclosed in U.S. Pat. No. 4,541,830, the disclosure of which is hereby incorporated by reference. Thus, one-, two-, three- or four-color elements (or higher numbers also) are included within the scope of the invention.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The invention will be further clarified by a consideration of the following examples, which are intended to be purely exemplary of the use of the invention.

EXAMPLE 1

(A) A yellow dye-donor element in accordance with the invention was prepared by coating the following layers in the order recited on a 6 μm poly(ethylene terephthalate) support:

(1) Subbing layer as indicated hereinafter (0.11 g/m$^2$) coated from isopropyl alcohol, and (2) Dye layer containing the yellow dye illustrated below (0.15 g/m$^2$), cellulose acetate propionate binder (2.5% acetyl and 45% propinyl) (0.32 g/m$^2$) from a toluene, methanol and cyclopentanone solvent mixture.

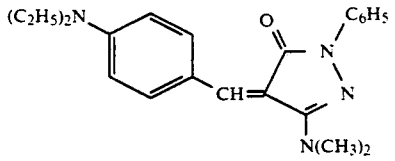

(Yellow)

On the backside of the dye-donor element was coated a slipping layer of Emralon 329 ® polytetrafluoroethylene dry film lubricant (Acheson Colloids) (0.54 g/m$^2$) from a n-propyl acetate, toluene, and methanol solvent mixture.

(B) A control element (C-1) was prepared similar to (A) except no subbing layer was coated underneath the dye layer.

(C) Control element (C-2) was prepared similar to (A), except that it had a Tyzor TBT ® (titanium-n-butoxide) (duPont Co.) (0.11 g/m$^2$) subbing layer.

(D) Control element (C-3) was prepared similar to (A), except it had only a poly(n-butyl methacrylate)(0.11 g/m$^2$) (no metal alkoxide) as a subbing layer.

(E) Control element (C-4) was prepared similar to (A), except it has an N-alkylacrylamide copolymerized with the alkoxysilane component.

(F) Control element (C-5) was prepared similar to (A), except it also had styrene copolymerized with the alkoxysilane component.

The polymers and copolymers of the control subbing layers C-3, C-4, and C-5 have the following structures:

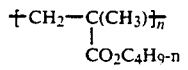

C-3

Poly (n-butyl methacrylate)

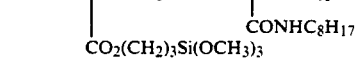

C-4

Silane component copolymerized wtih N-(t-octyl) acrylamide

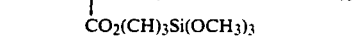

C-5

Silane component copolymerized with styrene

The dye receiving element was prepared by coating the following layers in the order recited onto a white reflective support of titanium dioxide-pigmented polyethylene-overcoated paper stock:

(a) a subbing layer of poly(acrylonitrile-co-vinylidene chloride-co-acrylic acid) (14:79:7 weight ratio) (0.08 g/m$^2$) coated from butanone;

(b) a dye-receiving layer of Makrolon 5705 ®, (a bisphenol A-polycarbonate resin) (Bayer AG ®) (2.9 g/m$^2$), Tone PCL-300 ® (a polycaprolactone)(Union Carbide) (0.38 g/m$^2$), and 1,4-didecoxy-2,5-dimethoxy benzene (0.38 g/m$^2$) from methylene chloride.

(c) overcoat layer of Tone PCL-300 ® (0.11 g/m$^2$), Fluorad FC-431 ® (a fluorocarbon surfactant) (3M Corp.) (0.011 g/m$^2$) and 510 Silicone Fluid (Dow Corning) (0.11 g/m$^2$) from methylene chloride.

The dye side of the dye-donor element strip about 10 cm×13 cm in area was placed in contact with the image-receiver layer side of a dye-receiver element of the same area. The assemblage was clamped to a stepper-motor driven 60 mm diameter rubber roller. A TDK Thermal Head L-231 (thermostatted at 23.5° C.) was pressed with a spring at a force of 36 N against the dye-donor element side of the assemblage pushing it against the rubber roller.

The imaging electronics were activated causing the donor-receiver assemblage to be drawn through the printing head/roller nip at 6.9 mm/sec. Coincidentally, the resistive elements in the thermal print head were pulsed for 29 μsec/pulse at 128 μsec intervals during the 33 msec/dot printing time. A stepped density image was generated by incrementally increasing the number of pulses/dot from 0 to 255. The voltage supplied to the printing head was about 24.5 volts, resulting in an instantaneous peak power of 1.4 watts/dot and a maximum total energy of 10.5 mJoules/dot.

The Status A blue maximum density of each of the stepped images was also read and recorded.

Using the same area of the receiver, a stepped image using an unused yellow dye donor area was recorded on top of the first stepped image. Note was made of any sticking when the donor was separated from the receiver. This repeat printing was attempted for up to twelve or more printings of dye-donor onto the same receiver. Sticking of the donor to the receiver indicated a poor subbing adhesion and removal of the dye-layer and a weak bond for the subbing layer. The number of transfers that could be made to the receiver before failure by layer removal occurred was also recorded as "prints to fail".

To evaluate dye stability of the dye-donor, the Status A blue transmission density of the dye-donor was read as coated and again after incubation for one week in the dark at 49° C. and 50% RH. The percent decrease in density was calculated as indicative of dye loss. The following results were obtained:

TABLE 1

| Sub Layer: Alkoxide (Mole Ratio) | Blue D-Max | Prints to Fail | % Dye Loss |
|---|---|---|---|
| E-1 (95:5) | 2.6 | >12 | <4 |
| E-1 (70:30) | 2.6 | >12 | 19 |
| E-2 (95:5) | 2.5 | 6 | 10 |
| E-3 (70:30) | 2.6 | >12 | 6 |
| C-1 (none) | 2.5 | 3 | <4 |
| C-2 (0:100) | 2.6, 2.5 | >12 | 18, 38 |
| C-3 (100:0) | 2.3 | 1 | <4 |
| C-4 (95:5) | 2.5 | 2 | <4 |
| C-5 (95:5) | 2.1 | 1 | <4 |

The results indicate that the dye-donor element having a subbing layer in accordance with the invention coated between the support and dye layer provide both improved adhesion (greater number of prints before separation) and less loss of dye due to decomposition within the dye-donor itself than the control subbing layers of the titanium tetraalkoxide alone, poly(alkyl acrylate) ester alone, or a copolymer of the silane with a monomer other than alkyl acrylate ester.

EXAMPLE 2

This example is similar to Example 1 but shows variations in the quantity of alkoxide component relative to that of the copolymer used in the mixture coated as a subbing layer.

Dye-donor elements were prepared as in Example 1. Copolymer E-1 (acrylate:silane mole ratio 95:5) was admixed with varying mole ratios of titanium tetra-n-butoxide as indicated below. Control dye-donors, C-6 to C-9, were prepared, as in Example 1, but have poly(n-butyl methacrylate) in the place of a silane containing copolymer admixed with the titanium tetra-n-butoxide. The coverage of subbing layer in each dye donor was 0.11 g/m$^2$.

Dye receiving elements were prepared as in Example 1.

Data for maximum transferred density, repeat printing-sticking, and dye-density loss of the donor were evaluated as in Example 1.

The following results were obtained:

TABLE 2

| Sublayer Copolymer: Alkoxide (Mole Ratio) | Blue D-Max | Prints to Fail | % Dye Loss |
|---|---|---|---|
| E-1 (100:0) | 2.4 | >12 | 4 |
| E-1 (99:1) | 2.7 | >12 | 4 |
| E-1 (98:2) | 2.7 | >12 | 4 |
| E-1 (95:5) | 2.8, 2.6 | >12 | 5, <4 |
| E-1 (70:30) | 2.6 | >12 | 19 |
| E-1 (40:60) | 2.6 | 4 | 16 |
| C-6 (100:0)* | 2.3 | 1 | <4 |
| C-7 (95:5)* | 2.3 | 3 | <4 |
| C-8 (87:13)* | 2.4 | 6 | 5 |
| C-9 (63:37)* | 2.5 | >12 | 12 |

(*Ratios of poly(n-butylmethacrylate):titanium n-butoxide.)

The results indicate that the dye-donor element comprising a subbing layer in accordance with the invention having levels upwards from 1 mole percent metal alkoxide in the subbing layer of the dye-donor element are beneficial. Some sticking of donor to receiver occur at the highest level of 60 mole percent metal oxide. High levels of metal alkoxide with the copolymer or use of the copolymer alone (100:0 mole ratio) are also undesirable because of lowered transfer density. The controls with the poly(n-butyl methacrylate) mixed with the alkoxide were all unsatisfactory in one respect or another.

EXAMPLE 3

This example is similar to Example 1 but shows the effectiveness of the subbing layer is maintained at decreased coverages of the mixture of alkoxide and copolymers.

Dye-donor elements were prepared in the same way as in Example 1. Copolymer E-1 (acrylate:silane mole ratio 95:5) mixed with the titanium tetra-n-butoxide (95:5 mole ratio of copolymer:alkoxide) was coated at different levels.

Dye receiving elements were prepared as in Example 1.

Data for maximum transferred dye density, repeat printing-sticking, and dye-density loss of the donor were evaluated as in Example 1.

The following results were obtained:

TABLE 3

| Sub Layer Coverage (g/m$^2$) | Blue D-Max | Prints to Fail | % Dye Loss |
|---|---|---|---|
| (0.0054) (Comparison) | 2.9 | 3 | <4 |
| (0.011) (Comparison) | 2.9 | 2 | <4 |
| (0.022) | 2.9 | >12 | <4 |
| (0.054) | 2.7 | >12 | <4 |
| (0.11) | 2.7 | >12 | <4 |

TABLE 3-continued

| Sub Layer Coverage ($g/m^2$) | Blue D-Max | Prints to Fail | % Dye Loss |
|---|---|---|---|
| (0.22) | 2.4 | >12 | <4 |

The results indicate that the dye-donor element having a subbing layer in accordance with the invention with moderate polymer/metal alkoxide level as little as 0.02 $g/m^2$ subbing layer is generally required for minimal sticking and negligible dye loss.

EXAMPLE 4

This example is similar to Example 1 but shows the effect of varying the ratio of the silane component of the copolymer relative to that of the acrylate in the subbing layer.

Dye-donor elements were prepared as in Example 1.

The silane used in each instance was methacryloxypropyltrimethoxy silane copolymerized with butyl methacrylate at a mole ratio specified hereinafter.

In each dye-donor the copolymer was admixed with the titanium tetra-n-butoxide in a ratio of copolymer:alkoxide of 95:5. The total coverage of subbing layer for each dye-donor was 0.11 $g/m^2$.

Dye receiving elements were prepared as in Example 1.

Data for maximum dye transferred density, repeat printing-sticking and dye-density loss of the donor were evaluated as in Example 1.

The following results were obtained:

TABLE 4

| Sub Layer Silanelacrylate Mole Ratio E-1* | Blue D-Max | Prints to Fail | % Dye Loss |
|---|---|---|---|
| E-1 (10:90) | 2.5 | 7 | <4 |
| E-1 (7.5:92.5) | 2.6 | >12 | <4 |
| E-1 (5:95) | 2.5 | >12 | <4 |
| E-1 (2.5:97.5) | 2.6 | >12 | <4 |

(*All these polymers were admixed with titanium tetra-n-butoxide in a copolymer: alkoxide ratio of 95:5.)

The results show that the dye-donor element having the subbing layer with less than 10 mole percent of the silane component in the copolymer admixed in a fixed ratio with the titanium alkoxide gave desirable results as a subbing layer. If the silane component was increased to more than ten percent, sticking of the donor to the receiver was observed.

EXAMPLE 5

This example is similar to Example 1 but shows the effect of using different titanium and zirconium alkoxides admixed with the copolymer in the subbing layer.

Dye-donor elements were prepared as in Example 1 using the alkoxides indicated below and described above admixed with copolymer E-1. A control dye-donor with only titanium tetra-n-butoxide was also prepared. All subbing layers were coated at 0.11 $g/m^2$.

Dye-receiving elements were prepared as in Example 1.

Data for maximum dye transferred density, repeat printing-sticking and dye-density loss of the donor were evaluated as in Example 1. The following results were obtained:

TABLE 5

| Subbing Layer: Alkoxide | Copoly: Alkoxide (Mole Ratio) | Blue D-Max | Prints to Fail | % Dye Loss |
|---|---|---|---|---|
| A (Ti) | 95:5 | 2.5 | >12 | <4 |
| B (Ti) | 95:5 | 2.5 | >12 | <4 |
| C (Ti) | 95:5 | 2.6 | >12 | <4 |
| D (Ti) | 95:5 | 2.6 | >12 | <4 |
| *Ti | * | 2.4 | >12 | <4 |
| E (Zr) | 95:5 | 2.6 | >12 | <4 |
| Control (Ti) | 0:100 | 2.7, 2.5 | >12 | 31, 13 |

(*This represents a "titanium sol-gel" coating where titanium tetra-n-butoxide (28.6 wt. %) was reacted with a mixture of ethanol (62.8 wt. %), acetic acid (7.9 wt. %), and water (1.7 wt. %) for 2 hours to induce partial hydrolysis and was then mixed with the copolymer in a 95:5 mole ratio.)

The results indicate that the dye-donor element having a subbing layer in accordance with the invention with alkoxides other than titanium-n-butoxide give equally good results.

Other embodiments of the invention will be apparent to the skilled in the art from a consideration of this specification or practice of the invention disclosed herein. It is intended that the specification and examples be considered as exemplary only, with the true scope and spirit of the invention being indicated by the following claims.

What is claimed is:

1. In a dye-donor element for thermal dye transfer comprising a polymeric support having thereon, in order, a subbing layer and a dye layer comprising a dye dispersed in a binder, the improvement wherein said subbing layer comprises a mixture of:

(A) a polymer having an inorganic backbone which is an oxide of a Group IVa or IVb element, and (B) a copolymer comprising recurring units of:

1) an acryloxyalkoxysilane or acrylamidoalkoxysilane, and 2) an alkyl acrylate ester.

2. The element of claim 1 wherein said Group IVa or IVb element is titanium, zirconium or silicon.

3. The element of claim 1 wherein said polymer having an inorganic backbone is formed from an inorganic titanate.

4. The element of claim 1 wherein said polymer having an inorganic backbone is formed from a titanium alkoxide.

5. The element of claim 4 wherein said titanium alkoxide is titanium tetra-n-butoxide.

6. The element of claim 1 wherein said polymer having an inorganic backbone is present in said mixture from 1 to about 50 mole percent.

7. The element of claim 1 wherein said polymeric support is poly(ethylene terephthalate).

8. The element of claim 1 wherein said aryloxyalkoxysilane or acrylamidoalkoxysilane has the following formula:

$$CH_2{=}\overset{R}{\overset{|}{C}}{-}\overset{O}{\overset{\|}{C}}{-}L{-}J{-}Si\left[OR^1\right]_m\left[R^2\right]_{3-m}$$

wherein:

R is hydrogen or a substituted or unsubstituted alkyl group having from 1 to about 6 carbon atoms;

$R^1$ and $R^2$ are each independently a substituted or unsubstituted akyl group having from 1 to about 6 carbon atoms; a substituted or unsubstituted cycloalkyl group having from 5 to about 7 carbon atoms;

or a substituted or unsubstituted aryl group having from about 6 to about 10 carbon atoms;

L is —O— or —NH—;

J is a bivalent linking group; and m is 1, 2 or 3.

9. The element of claim 8 wherein R is methyl, L is 0, J is $(CH_2)_3$, $R^1$ is methyl and m is 3.

10. The element of claim 8 wherein said silane is present in said copolymer in an amount of up to about 20 mole percent.

11. The element of claim 1 wherein said alkyl acrylate ester or alkyl acrylate amide has the following formula:

$$CH_2{=}CR{-}CO_2{-}G$$

wherein:

R is hydrogen or a substituted or unsubstituted alkyl group having from 1 to about 6 carbon atoms; and G is a substituted or unsubstituted alkyl group having from 1 to about 20 carbon atoms; a substituted or unsubstituted cycloalkyl group having from about 5 to about 10 carbon atoms; or a substituted or unsubstituted aryl group having from about 6 to about 10 carbon atoms.

12. The element of claim 11 wherein R is methyl, and G is methyl, propyl or butyl.

13. In a process of forming a dye transfer image comprising:

(A) imagewise-heating a dye-donor element comprising a polymeric support having thereon, in order, a subbing layer and a dye layer comprising a dye dispersed in a binder, and (B) transferring a dye image to a dye-receiving element to form said dye transfer image, the improvement wherein said subbing layer comprises a mixture of:

(1) a polymer having an inorganic backbone which is an oxide of a Group IVa or IVb element, and (2) a copolymer comprising recurring units of:

a) an acryloxy-alkoxysilane or acrylamidoalkoxysilane, and b) an alkyl acrylate ester.

14. The process of claim 13 wherein said acryloxyalkoxysilane or acrylamidoalkoxysilane has the following formula:

$$CH_2{=}\overset{R}{\overset{|}{C}}{-}\overset{O}{\overset{\|}{C}}{-}L{-}J{-}Si\left[OR^1\right]_m\left[R^2\right]_{3-m}$$

wherein:

R is hydrogen or a substituted or unsubstituted alkyl group having from 1 to about 6 carbon atoms;

$R^1$ and $R^2$ are each independently a substituted or unsubstituted akyl group having from 1 to about 6 carbon atoms; a substituted or unsubstituted cycloalkyl group having from 5 to about 7 carbon atoms; or a substituted or unsubstituted aryl group having from about 6 to about 10 carbon atoms;

L is —O— or —NH—;

J is a bivalent linking group; and m is 1, 2 or 3.

15. The process of claim 14 wherein R is methyl, L is 0, J is $(CH_2)_3$, $R^1$ is methyl and m is 3.

16. The process of claim 13 wherein said alkyl acrylate ester or alkyl acrylate amide has the following formula:

$$CH_2{=}CR{-}CO_2{-}G$$

wherein:

R is hydrogen or a substituted or unsubstituted alkyl group having from 1 to about 6 carbon atoms; and G is a substituted or unsubstituted alkyl group having from 1 to about 20 carbon atoms; a substituted or unsubstituted cycloalkyl group having from about 5 to about 10 carbon atoms; or a substituted or unsubstituted aryl group having from about 6 to about 10 carbon atoms.

17. In a thermal dye transfer assemblage comprising:

(A) a dye-donor element comprising a polymeric support having thereon, in order, a subbing layer and a dye layer comprising a dye dispersed in a binder, and (B) a dye-receiving element comprising a support having thereon a dye image-receiving layer, said dye-receiving element being in superposed relationship with said dye-donor element so that said dye layer is in contact with said dye image receiving layer, the improvement wherein said subbing layer comprises a mixture of:

(1) a polymer having an inorganic backbone which is an oxide of a Group IVa or IVb element, and (2 ) a copolymer comprising recurring units of:

a) an acryloxy-alkoxysilane or acrylamidoalkoxysilane, and b) an alkyl acrylate ester.

18. The assemblage of claim 17 wherein said acryloxyalkoxysilane or acrylamido-alkoxysilane has the formula:

$$CH_2{=}\overset{R}{\overset{|}{C}}{-}\overset{O}{\overset{\|}{C}}{-}L{-}J{-}Si\left[OR^1\right]_m\left[R^2\right]_{3-m}$$

wherein:

R is hydrogen or a substituted or unsubstituted alkyl group having from 1 to about 6 carbon atoms;

$R^1$ and $R^2$ are each independently a substituted or unsubstituted akyl group having from 1 to about 6 carbon atoms; a substituted or unsubstituted cycloalkyl group having from 5 to about 7 carbon atoms; or a substituted or unsubstituted aryl group having from about 6 to about 10 carbon atoms;

L is —O— or —NH—;

J is a bivalent linking group; and m is 1, 2 or 3.

19. The assemblage of claim 17 wherein said alkyl acrylate ester has the following formula:

$$CH_2{=}CR{-}CO_2{-}G$$

wherein:

R is hydrogen or a substituted or unsubstituted alkyl group having from 1 to about 6 carbon atoms; and G is a substituted or unsubstituted alkyl group having from 1 to about 20 carbon atoms; a substituted or unsubstituted cycloalkyl group having from about 5 to about 10 carbon atoms; or a substituted or unsubstituted aryl group having from about 6 to about 10 carbon atoms.

20. The assemblage of claim 19 wherein R is methyl, and G is methyl, propyl or butyl.

* * * * *